US007089944B2

(12) United States Patent
Schlisio

(10) Patent No.: US 7,089,944 B2
(45) Date of Patent: Aug. 15, 2006

(54) PROCESS AND DEVICE FOR CONNECTING SMOKING ARTICLES

(75) Inventor: Siegfried Schlisio, Geesthacht (DE)

(73) Assignee: Hauni Maschinenbau AG, Hamburg (DE)

( * ) Notice: Subject to any disclaimer, the term of this patent is extended or adjusted under 35 U.S.C. 154(b) by 373 days.

(21) Appl. No.: 10/382,491

(22) Filed: Mar. 7, 2003

(65) Prior Publication Data

US 2003/0172942 A1 Sep. 18, 2003

(30) Foreign Application Priority Data

Mar. 12, 2002 (DE) ..... 102 10 760

(51) Int. Cl.
*A24C 5/47* (2006.01)

(52) U.S. Cl. ..... 131/94; 131/88

(58) Field of Classification Search ..... 131/88, 131/94, 58

See application file for complete search history.

(56) References Cited

U.S. PATENT DOCUMENTS 2,189,886 A * 2/1940 Edwards ..... 131/94
2,808,059 A 10/1957 Stelzer
3,527,234 A 9/1970 Hinzmann
4,003,386 A 1/1977 Bald et al.
4,506,779 A 3/1985 Seragnoli
4,614,198 A * 9/1986 Hinchcliffe et al. ..... 131/94

FOREIGN PATENT DOCUMENTS

| | | |
|---|---|---|
| DE | 956208 | 2/1957 |
| DE | 1258773 | 1/1968 |
| DE | 1632193 | 11/1970 |
| DE | 2517299 | 11/1975 |
| DE | 3137223 | 2/1990 |
| DE | 19857576 | 6/2000 |
| EP | 0687424 | 12/1995 |
| EP | 0821887 | 2/1998 |
| GB | 1019842 | 2/1966 |

* cited by examiner

*Primary Examiner*—Dionne W. Mayes
(74) *Attorney, Agent, or Firm*—Greenblum & Bernstein, P.L.C.

(57) ABSTRACT

Process and apparatus for connecting smoking article components. Process includes feeding connecting sheets on a suction roller with a defined spacing, feeding the smoking article components on a grooved drum, and transferring portions of the connecting sheets to the smoking article components, such that the connecting sheets partially connect the smoking article components. The instant abstract is neither intended to define the invention disclosed in this specification nor intended to limit the scope of the invention in any way.

59 Claims, 2 Drawing Sheets

PROCESS AND DEVICE FOR CONNECTING SMOKING ARTICLES

CROSS-REFERENCE TO RELATED APPLICATIONS

The present application claims priority under 35 U.S.C. §119 of German Patent Application No. 102 10 760.2, filed on Mar. 12, 2002, the disclosure of which is expressly incorporated by reference herein in its entirety.

BACKGROUND OF THE INVENTION

1. Field of the Invention

The present invention relates to a process for connecting smoking article components with glued connecting sheets fed on a suction roller with a defined spacing, and feeding at least one cigarette/tip group (or cigarette/filter group) on a grooved drum.

The present invention also relates to a device for connecting smoking article components with glued connecting sheets fed on a suction roller with a defined spacing, and for conveying at least one cigarette/tip group on a grooved drum. The invention further relates to a machine of the tobacco processing industry, in particular, filter tipping machines.

According to the instant invention, a defined spacing refers to a spacing determined by a predetermined length of the connecting sheets.

2. Discussion of Background Information

A device for connecting cigarette/tip groups by winding with glued connecting sheets is known, e.g., from European Patent Application No. EP-A-0 687 424, according to which the smoking article components are moved through a rolling channel and thereby turned about their own axis during their forward movement.

A process and device of the type described above are used, e.g., in packaging filter cigarettes conveyed in a cross-axial manner on a so-called "filter tipping machine." Their capacity regarding the articles produced and discharged per unit time has increased sharply again and again over years or had to be adapted to the increased capacity of the upstream cigarette rod machine. As a partial installation on a filter tipping machine, the roll device mentioned at the outset thereby reaches a critical capacity limit, exceeding which can inevitably lead to a reduction in quality or increased tobacco wastage, damage, deformation or even destruction of the produced cigarettes.

Published German Patent Application No. DE 25 17 299 discloses a device for connecting coating paper strips and cigarette filter/cigarette groups, in which the coating paper is fed on a grooved drum. During the transfer of the groups to the coating paper feed drum, the coating paper is wrapped around the group.

Furthermore, a generic process and a generic device for connecting smoking articles are described in European Patent No. EP-B-0 821 887. According to the technical teaching, smoking article components are connected by two consecutive rolling procedures. The first partial rolling hereby occurs in the seat of the grooved drum during and at the transfer of the connecting sheet to a cigarette/tip group. The end rolling is conducted in the form of a multiple rolling of the partially connected components in another process step.

SUMMARY OF THE INVENTION

The present invention ensures production of high product quality smoking articles, even at higher productive capacities.

According to the invention, a process of the type mentioned at the outset further includes that a cigarette/tip group is partially enclosed by the connecting sheet during its transfer to the cigarette/tip group and that, in a subsequent part of the process, the connecting sheet is wrapped around the joint or junction point of the cigarette/tip group by rolling over the components.

The invention is based on the idea that a partial wrapping of the group at a predetermined enclosing angle occurs during the transfer of the connecting sheet to the cigarette/tip group. According to the invention, the cigarette/tip group does not change its position on or in the grooved drum (trough drum), i.e., it is not rolled during the partial wrapping. Because partial wrapping occurs during the transfer of the connecting sheet to the cigarette/tip group for connecting the components, a free length of the connecting sheet is already shortened during this process, so that the end of the paper is released by a following cigarette/tip group or is not caught up by it. Consequently, the length of the free end of the connecting sheet does not change and projects from the cigarette like a kind of little tag from the cigarette. In order to establish a complete connection of the connecting sheet to the cigarette/tip group, the connecting sheet is subsequently wrapped around the joint or junction point of the cigarette/tip group by rolling the components.

In order to provide the partial wrapping of the cigarette/tip group with the glued connecting sheet, the cigarette/tip group is at least partially inserted into a seat of a suction roller. The seat of the suction roller is embodied or provided in a form and/or form-complementary manner to the shape or profile of the cigarette/tip group so that the coated paper strip, i.e., connecting sheet, can be partially wrapped around the group and adhered to it.

A secure initial contact between the connecting sheet and the cigarette/tip group is achieved when the connecting sheet is arranged asymmetrically to the seat of the suction roller. This arrangement is favorable for the process, particularly when an front end of the connecting sheet lying in front of the seat, relative to a movement direction of the suction roller, is shorter than the rear end of the connecting sheet.

Moreover, the group is reliably partially wrapped when the connecting sheet is held asymmetrically and/or partially during the transfer.

A secure partial wrapping of the cigarette/tip group is achieved when a portion of the connecting sheet not held by the suction roller is at least partially adhered to the cigarette/tip group.

Furthermore, the connecting sheet is advantageously held by being acted on by a vacuum from at least two suction borings of the suction roller.

The cigarette/tip group can be wrapped around by the connecting sheet without creasing if the vacuum at the suction borings is switched off in a predetermined order. By switching off the vacuum, the released part of the connecting sheet at the suction roller or at the suction boring can wrap smoothly around the cigarette/tip group. When the suction air is switched off at the suction boring arranged in front of the transfer groove of the roller, with respect to the movement direction of the suction roller, the front part of the connecting sheet can rest on the group and be adhered to it by inserting the cigarette/tip group into the seat.

According to a particularly advantageous further development of the invention, a displacement of the partially connected components is carried out, in particular, after the transfer of the connecting sheet to the cigarette/tip group. According to the invention, a position movement or change of the partially connected components is not conducted until after the connection by the partial wrapping of the components. Further, the cigarette/tip group is not rolled up by the position movement of the partially connected components. Thus, the length of the free end of the connecting sheet attached to the cigarette/tip group does not change. However, the relative arrangement of the coating tag to the cigarette/tip group does change. This applies, in particular, to the relative position of the end of the tag to the central axis of the cigarette/tip group. Above all, a reduction in the spacing between the center of the group and the free end of the connecting sheet can be achieved by position movement of the partially connected components.

In a particularly advantageous further development of the invention, it is provided that the displacement of the partially connected components is carried out in a seat of the grooved drum. The relative position of the free part of the coating paper to the cigarette/tip group changes through the position displacement, whereby the length of the free coating paper tag essentially remains constant. However, the distance between the projecting end of the paper to the center axis (axis of symmetry) of the cigarette/tip group does change. In this regard, the position of the rolling edge of the coating paper is displaced in the groove seat.

Furthermore, it is advantageous if the displacement is carried out by an acceleration process of the partially connected components. The position of the partially connected components in the seat of a grooved drum changes due to an acceleration exerted on the partially connected components. Since the partially connected components are already moved with the grooved drum, a relative acceleration must also be applied to the components so that they adopt another position on the seat on the moved seat.

Moreover, it is advantageous if the spacing between the partially connected components is reduced. That is, after joining the partially connected components and the partial wrapping, a distance between the free end of the connecting sheet and a following partially wrapped cigarette/tip group is larger than with cigarette/tip groups in which the paper is attached at one place according to the prior art. With a reduction of the spacing according to the invention, e.g., via movable arms of the grooved drum, a conveyor arranged downstream of the grooved drum can be operated with a smaller spacing, so that overall the productivity of a machine can be increased with a high product quality. Thus, more cigarettes per minute can be transported or produced in a machine by changing the spacing. At the same time, the smoking article components are handled gently.

It is particularly advantageous if the spacing of the seats of the grooved drum is reduced during and/or after the displacement. The reduction of the spacing is based on the idea that the free end of the coating paper tag is not shortened by the position movement. The spacing between two consecutive, partially connected components can be changed by the displacement of the components and the change of the relative position. It should thereby be ensured that the end of the paper is not caught by the following cigarette/tip group. The transfer of the partially connected smoking article components to a transfer drum can subsequently occur with a smaller spacing due to the reduction of the spacing of the partially wrapped and displaced articles.

According to an advantageous further development of the process, after the position change, the partially connected components are transferred to a drum, in particular with a spacing corresponding to the reduced spacing of the grooved drum. As a result, a filter assembler can be operated with a lower spacing after the transfer of the components from a rod unit.

In order to join the smoking article components securely, it is provided according to the invention for the connecting sheets and the cigarette/tip groups to be joined with the same spacing.

When the spacing between the partially connected components is changed, it is necessary for the spacing of the seats of the grooved drum to be increased after the transfer of the partially connected components. The adjustment of the reduced spacing to the original spacing guarantees a reliable operation of the process or of a device.

A secure adhesive connection is ensured in that, according to a further recommendation, a final rolling is carried out after the transfer of the partially connected components to the drum.

In particular, it is advantageous when the final rolling is carried out in the form of a multiple rolling of the components.

The present invention provides a device of the type mentioned at the outset which further includes at least one device for the partial connection of the smoking components during a transfer of the connecting sheet to the cigarette/tip group.

In order to provide the cigarette/tip group with a partial wrapping during joining to the connecting sheet according to the invention, the suction roller features recesses, in particular, semi-circular recesses.

If the recess is embodied asymmetrically with respect to the position of the connecting sheet, a front part, relative to a movement direction of the paper, can be pressed onto the cigarette/tip group after suction air holding the front part to the suction roller has been switched off. The rear part of the connecting sheet forms the free end like a kind of tag.

The suction roller preferably features at least two suction borings to hold a connecting sheet. The suction borings are acted on by a vacuum and hold the connecting sheet. Favorable results can be obtained by at least one suction boring being arranged before and at least one boring being arranged after the recess with respect to the conveyor direction of the suction roller.

The connecting sheet can be applied without creases with a partial wrapping during the transfer of the connecting sheet to the cigarette/tip group if the suction borings can be switched off, preferably in a predetermined order.

It is provided according to a further development according to the invention that a position change element is provided for displacing the partially connected components. The displacement or movement of the partially connected components causes a relative position change of the cigarette/tip group and the connecting sheet relative to one another, without a further wrapping up or wrapping round of the group taking place.

In particular, it is advantageous if the spacing between the seats of the grooved drum can be changed. In this manner, the partially connected components can be transferred to a transfer drum with a lower spacing.

A relative change in the position of the partially connected components can easily be carried out if the seats of the grooved drum are widened. Because of the widening of the seats, the cigarette/tip group can be rolled in the seat, whereby the cigarette/tip group is not rolled up further by the connecting sheet.

The seats preferably feature a supporting shoulder and/or a roughened surface. This makes it possible for the cigarette/tip group to be moved and arranged exactly in the seat.

To change the spacing, at least one device is provided for changing the spacing between the seats.

A position movement of the partially connected components in the seat of the grooved drum is achieved if the position change element is arranged between the suction roller and a transfer drum, with respect to the conveyor direction of the grooved drum.

The position change in the seat is rendered possible by a position change element, which features at least one sliding element for the partially connected components. The sliding element exerts an acceleration on the partially connected components and causes a position change of the components in the seat. In this context, "position change" refers to the movement of the group about its axis without the coating paper being further wrapped around this group.

According to an advantageous embodiment of the invention, the position change element is embodied or formed as a rotational body.

Moreover, the partially connected components can be moved in the seat of the grooved drum, when the sliding element is arranged with a larger spacing than the largest spacing of the seats of the grooved drum. Through a larger spacing of the sliding elements, the partially connected components in the seat are subject to a relative acceleration, whereby a different position in the seat of the grooved drum is adopted.

Furthermore, it is advantageous if at least one rolling station is provided for wrapping the connecting sheet around the joint or junction point of the cigarette/tip group. The roller station can be realized by, e.g., a rolling block, as shown, e.g., in DT-PS 16 32 193 or alternatively a rolling channel embodied by belts, as shown, e.g., in DE-A-198 57 576. Moreover, the disclosures of both these above-noted documents are expressly incorporated by reference herein in their entireties.

The instant invention further provides a machine of the tobacco processing industry, in particular a filter tipping machine, that includes a device in accordance with the features of the invention discussed above.

A consistent or possibly even reduced article strain during the production process is achieved by the invention with a desired and achieved higher output rate and thus production rate of the filter cigarette lines. Moreover, a reduction in speed and a resulting noise reduction can be achieved through the invention, so that overall the efficiency of a filter tipping machine can be increased.

The present invention is directed to a process for connecting smoking article components. The process includes feeding connecting sheets on a suction roller with a defined spacing, feeding the smoking article components on a grooved drum, and transferring portions of the connecting sheets to the smoking article components, such that the connecting sheets partially connect the smoking article components.

In accordance with a feature of the invention, the connecting sheets can include glued connecting sheets.

According to another feature of the invention, the smoking article components may include cigarette/tip groups. The cigarette/tip groups include at least one joint formed between a tobacco rod and a filter, and the transferring can include partially wrapping the at least one joint with at least one of the connecting sheets. The process can also include rolling the partially wrapped cigarette/tip group to wrap an unwrapped portion of the at least one connecting sheet around the at least one joint.

In accordance with still another feature of the invention, the process can further include rolling the partially connected smoking article components in order to wrap an unwrapped portion of the connecting sheets around the smoking components.

According to another feature of the present invention, the cigarette/tip group can be at least partially inserted into a seat of the suction roller. Further, the connecting sheet can be asymmetrically positioned relative to the seat of the suction roller.

According to a further feature, the suction roll may be arranged to hold the connecting sheet at least one of asymmetrically, relative to a recess in the suction roll, and partially.

Moreover, the connecting sheet can be held asymmetrically prior to being transferred to the smoking article components and can be held partially while being transferred to the smoking article components. When the connecting sheet is partially held by the suction roller, a part of the connecting sheet not being held by the suction roller can at least partially adhered to the smoking article components.

The process can further include holding each of the connecting sheets on the suction roller with a vacuum from at least two suction borings of the suction roller. The vacuum at the at least two suction borings can be switched off in a predetermined order.

Further, after the connecting sheets are transferred to the smoking article components, the process may further include displacing the partially connected smoking article components. The displacement of the partially connected smoking article components may occur within a seat of the grooved drum. The displacement can also include accelerating the partially connected smoking article components.

The process can also include reducing a spacing of the partially connected smoking article components. At least one of during and after the displacement, the spacing of the seats of the grooved drum can be reduced. Further, after the displacement, the process can further include transferring the partially connected smoking article components to a roller drum. A spacing of the transferred partially connected smoking article components corresponds to the reduced spacing of the grooved drum after the displacement. After the transfer to the roller drum, the connecting sheets and the smoking article components can be joined with a same spacing.

Before transferring the connecting sheets to the smoking article components, the connecting sheets and the smoking article components may be fed with a same spacing.

The connecting sheets and the smoking article components can be joined with a same spacing. After transfer of the partially connected components to the roller drum, the spacing of the seats of the grooved drum can be increased. The process can also include rolling the smoking article components after the transfer to the roller drum to wrap the connecting sheet around the smoking article component.

The process can further include multiple rolling of the partially connected smoking article components.

Moreover, the process can further include at least one of accelerating and displacing the partially wrapped connecting sheets and smoking article components in a seat of the grooved drum.

The present invention is directed to a process for connecting tobacco rods and filters arranged as cigarette/tip groups. The process includes feeding adhesive connecting sheets on a suction roller, feeding the cigarette/tip groups on a grooved drum, and connecting portions of the connecting sheets to junction points between the tobacco rods and the filters without rotating the cigarette/tip groups, thereby partially connecting the connecting sheets and cigarette/tip groups.

In accordance with a feature of the invention, the connecting of portions of the connecting sheets to the junction points can include inserting portions of the cigarette/tip groups and ends of the connecting sheets into recesses in the suction roll. The ends of the connecting sheets may include leading edges, relative to a connecting sheet feed direction, of the connecting sheets.

According to another feature of the invention, prior to the connecting, the connecting sheets can be arranged asymmetrically over recesses of the suction roller, relative to a connecting sheet feed direction, and the process can further include suctioning both ends of the connection sheets, relative to the connection sheet feed direction. The suctioning can be discontinued on the leading sides of the recesses during the connections of the connecting sheets to the cigarette/tip groups, and at least portions of the cigarette/tip groups may be inserted into the recesses of the suction roller along with leading edges of the connecting sheets released by the suction roller when the suctioning on the leading sides of the recesses was discontinued.

The process can further include rotating the partially connected connecting sheets and cigarette/tip groups within seats of the groove drum. The partially connected connecting sheets and cigarette/tip groups may be rotated by an acceleration force applied to the cigarette/tip groups by a star roller. At least one of during and after rotating the partially connected connecting sheets and cigarette/tip groups, a spacing between successive partially connected connecting sheets and cigarette/tip groups is reduced. The spacing may be reduced to correspond to a spacing on a roller drum arranged downstream from the star roller. The process can also include transferring the partially connected connecting sheets and cigarette/tip groups to the roller drum.

According to still another feature of the invention, the process can include rolling the partially connected connecting sheets and cigarette/tip groups, whereby the connecting sheets completely wrap around the cigarette/tip groups.

The instant invention is directed to a device for connecting smoking article components that includes a suction roller structured and arranged to feed connecting sheets with a defined spacing, and a grooved drum arranged to feed the smoking article components. The suction roller and the grooved drum are arranged to transfer the connecting sheets to the smoking article components and to partially connect the connecting sheets and the smoking article components.

According to a feature of the instant invention, the connecting sheets can include glued connecting sheets.

Further, the smoking article components can include tobacco rods and filters arranged into cigarette/tip groups, and the suction roller and the grooved drum can be arranged to transfer the connecting sheets to junction points between the tobacco rods and filters of the cigarette/tip groups and to partially connect the connecting sheets and cigarette/tip groups.

In accordance with another feature of the present invention, the suction roller may include semicircular recesses. The recesses may be positioned asymmetrically with regard to a feed position of the connecting sheets.

The suction roller can include at least two suction borings to hold a connecting sheet. The suction borings can be switched off in a certain order. The suction borings can be arranged on opposite sides of recesses formed in the suction roller. Further, the recesses can be asymmetrically positioned under the connecting sheets being fed by the suction roller.

According to the invention, the device may also include at least one position change element arranged to displace the partially connected connecting sheets and the smoking article components. Further, a transfer drum may be arranged downstream from the suction roller, with respect to a machine direction, and the position change element can be positioned between the suction roller and the transfer drum. The position change element may include at least one sliding element arranged to contact the partially connected connecting sheets and the smoking article components. Moreover, the at least one sliding element can include a plurality of sliding elements arranged with a larger spacing than a largest spacing of seats of the grooved drum. The position change element may include a rotational body.

Still further, the grooved drum may include a plurality of seats structured and arranged such that spacing between the seats can be changed. The seats can be structured to be wider than a circumference of the smoking article components. The seats may include at least one of a supporting shoulder and a roughened surface. Further, the device can include a device for changing the spacing between the seats of the grooved drum.

According to the invention, at least one rolling station can be arranged to wrap the connecting sheets around the junction points of the smoking article components.

Moreover, a position change element can be arranged to contact the smoking article components. The position change element may be arranged to at least one of accelerate and displace the smoking article components partially connected to the connecting sheets in seats of the grooved drum.

The present invention is directed to a machine of the tobacco processing industry comprising the above described device. Further, the machine can be structured and arranged as a filter tipping machine.

The instant invention is directed to an apparatus arranged to at least one of accelerate and displace partially connected connecting sheets and smoking article components being fed at a defined spacing in a tobacco processing machine. The apparatus includes a rotational body having a plurality of contact surfaces. The contact surfaces are spaced a distance greater than the spacing between the fed partially connected components. The apparatus also includes projecting elements extending from the rotational body and arranged in front of the contact surfaces, relative to a rotational direction, and a device for rotating the contact surfaces at a speed greater than a feeding speed of the partially connected components.

The plurality of contact surfaces can be curved inwardly on the rotational body. Further, the contact surfaces may include one of a serrated or ribbed surfaces.

According to another feature of the invention, the projecting elements can be arranged to rotate and displace the partially connected elements.

In accordance with still yet another feature of the present invention, after the projecting elements rotate and displace the partially connected elements, the contact surfaces can be arranged to rest on the partially connected elements.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
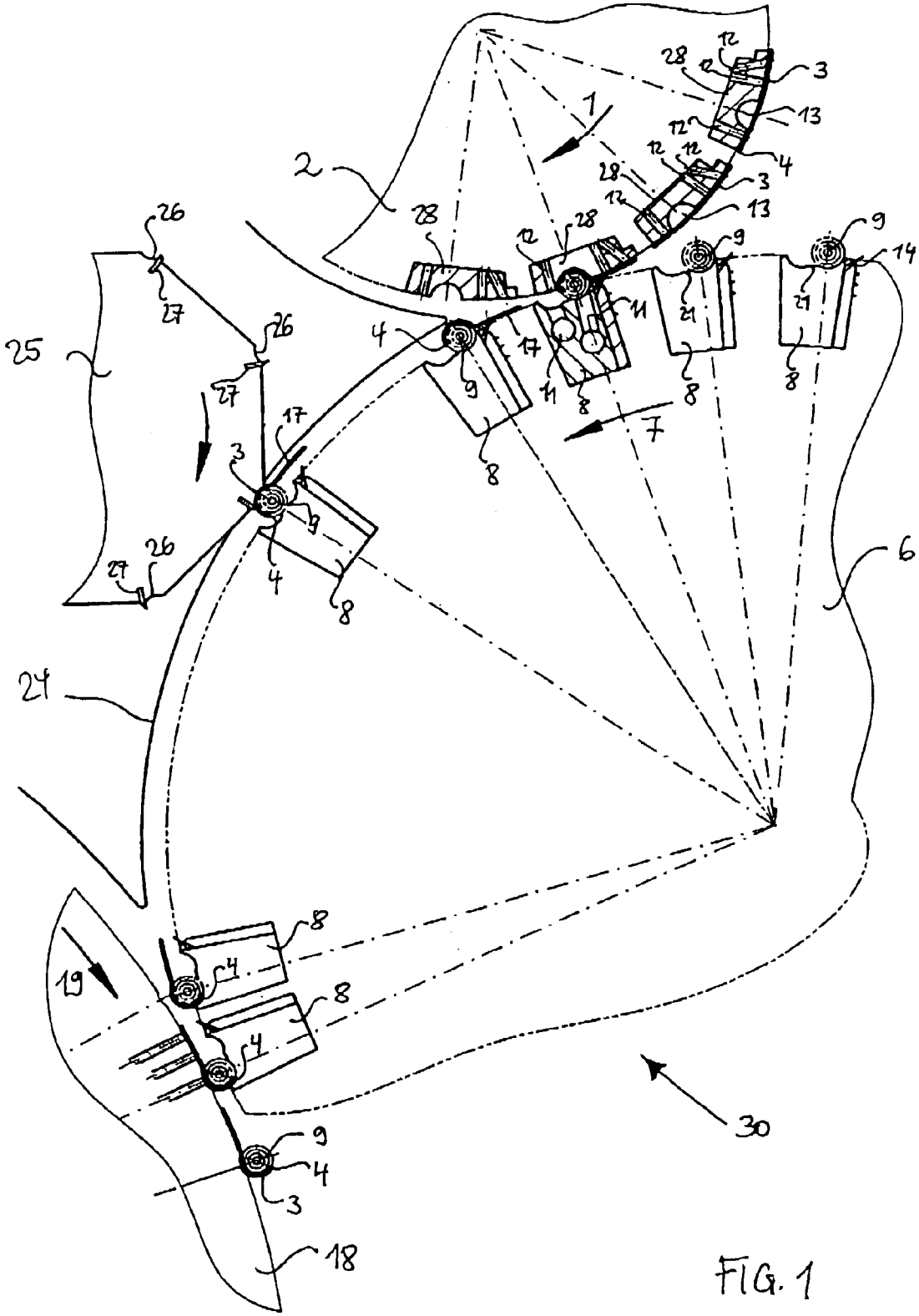
FIG. 1 illustrates a sectioned view of a drum arrangement of a filter tipping machine in section.

Same elements in the exemplary illustrations are assigned the same reference numerals. FIG. 1 illustrates, in section, a device 30 according to the invention with a plurality of drums, as embodied or arranged, e.g., in a filter tipping machine. A suction roller 2 is arranged as a conveyor for device 30, such that suction roller 2 rotates in a direction of arrow 1 in order to feed connecting sheets or strips 3 with a defined spacing, predetermined by the length of connecting sheets 3. Further, connecting sheets 3 are provided with an adhesive, e.g., glue, on its surface opposite suction roller 2. Connecting sheets 3 are arranged on carrier brackets 28 of suction roller 2, and held on carrier brackets 28 by suction created by vacuum intake openings 12. In this regard, connecting sheets 3 are arranged on carrier brackets 28 such that a leading end or edge of connecting sheet 3, i.e., edge 4, determined relative to the movement direction of connecting sheets 3 on suction roller 2, is held on one side of a recess 13 in carrier bracket 28 of suction roller 2 by at least one of vacuum intake air openings 12, and a trailing end or edge of connecting sheet 2 is held on an opposite side of recess 13 by at least one other of vacuum intake air openings 12. In this manner, connecting sheet is initially conveyed by suction roller 2 to span recess 13.

Moreover, as depicted in the exemplary illustration of FIG. 1, recess 13 is asymmetrically arranged in each carrier bracket 28 and structured to receive inserted cigarette/tip groups 9. In this regard, cigarette/tip groups 9 can include, e.g., a combination of tobacco rods and tips, e.g., filters, that are conveyed together, such that a joint or junction point exists between the individual components, but these components are not yet permanently joined together. As shown in FIG. 1, grooved (or trough) drum 6 is utilized to convey cigarette/tip groups 9 in a direction of arrow 7 in a plurality of drum seats 8 formed on movable groove arms. A transfer device with moveable arms for rod-shaped articles is disclosed, e.g., by German Patent No. DE-C-31 37 223, the disclosure of which is expressly incorporated by reference herein in its entirety.

Drum seats 8 are each arranged to accept one cigarette/tip group 9. In order to carry out a position change of the group 9 within drum seat 8, drum seats 8 are widened in cross section. Furthermore, drum seats 8 can include a holding shoulder 21 positioned in a center region of drum seats 8 in order to precisely accept cigarette/tip group 9 or to change its position. Alternatively, the receiving surface of drum seat 8 can be roughened or ribbed.

When transferring connecting sheet 3 to cigarette/tip groups 9, leading edges 4 of connecting sheets 3 are arranged on suction roller 2 spaced from each other a distance that corresponds to the spacing between cigarette/tip groups 9 seated in drum seats 8 and a distance such that no overlap occurs between adjacent connecting sheets on suction roller 2. Furthermore, drum seats 8 are formed to be larger than the diameter of cigarette/tip groups 9 and are provided with vacuum intake air openings 11 to hold cigarette/tip groups 9 in the desired seating position.

Connecting sheets 3 and cigarette/tip group 9 are moved towards one another and joined via the synchronous rotation of suction roller 2 and grooved drum 6. During this joining of connecting sheet 3 to cigarette/tip group 9, cigarette/tip group 9 is brought toward recess 13 of carrier bracket 28 and subsequently inserted into recess 13. As cigarette/tip group 9 is inserted into recess 13, the vacuum intake air provided to hold leading edge 4 of connecting sheet 3 on carrier bracket 28 is switched off. In this manner, the insertion of cigarette/tip group 9 into recess 13 effects a wrapping of a front end of connecting sheet 3 around the cigarette/tip group 9 and, therefore, a partial connection between connecting sheet 3 (i.e., the front end) and cigarette/tip group 9 results. Moreover, it is noted that this partial wrapping occurs by the insertion of cigarette/tip groups 9 and without rotation of the cigarette/tip groups 9 in recesses 13.

A length of the front end of connecting sheet 3 that is arranged to partially wrap group 9 corresponds to the circumference of recess 13, so that, when group 9 is inserted into recess 13, the front end of connection sheet 13, i.e., the length of connection sheet spanning recess 13 and leading edge 4, on carrier bracket 28 is preferably dimensioned so that this front end of connecting sheet 3 is almost completely pressed into recess 13 during insertion of cigarette/tip group 9 into recess 13.

The partially connected or partially wrapped components, i.e., cigarette/tip groups 9 partially wrapped by connection sheets 3, are subsequently moved away from suction roller 2 in a direction of a transfer drum 18. The partially wrapped components of connecting sheet 3 and cigarette/tip group 9 are moved along a sheet guide 24, which is arranged to prevent separation of connecting sheet 3 from partially wrapped cigarette/tip group 9.

According to FIG. 1, the partially wrapped combination of connecting sheet 3 and cigarette/tip group 9 is fed along sheet guide 24 to a rolling star 25 that is formed as a rotational body with contact surfaces 26 arranged in a star-shaped manner on the outside. The spacing of contact surfaces 26 of rolling star 25 is (somewhat) larger than the spacing of drum seats 8 on suction roller 2 and the spacing of carrier brackets 28 (recesses 13) of suction roller 2. In order to carry out a position movement, contact surfaces 26 feature a higher circumferential speed than the groove arms with drum seats 8.

Contact surfaces 26 are synchronized with the seat position of the partially wrapped combination of connecting sheet 3 and cigarette/tip group 9 in drum seat 8 such that contact surfaces 26 cause a seat position change of the partially wrapped components in drum seat 8. Rolling star 25 exerts a (small) relative acceleration of the partially wrapped components so that a position movement of the partially wrapped components is effected within drum seat 8. A relative position of cigarette/tip group 9 to a free end 17 of connecting sheet 3 changes as the partially wrapped components changes seating positions in drum seat 8.

At a same time as, or after, the position change of the partially connected components in drum seat 8, a spacing between drum seats 8 is shortened, so that drum seats 8, i.e., subsequent to the roller star 25 and in the region of roller drum 18, exhibit a reduced spacing as compared to the drum groove spacing for transferring connecting sheets 13 to cigarette/tip groups 9. Accordingly, after the transfer of the partially wrapped components to roller drum 18, the spacing between drum seats 8 is again enlarged to correspond to the spacing of connecting sheets 3 on suction roller 2.

Roller drum 18 transfers the partially wrapped combination of connecting sheet 3 and cigarette/tip group 9 in a direction of arrow 19 to a rolling station (not shown), at which a rolling channel is formed, e.g., between a rolling block and an outer circumference of roller drum 18. The rolling surface of the rolling block is substantially longer than the circumferential surface of cigarette/tip 9 so that cigarette/tip group 9 can be rolled several times, thereby connecting connecting sheet 3 to the joint or junction point between the cigarette/tip group components. In this regard, it is noted that the above-noted roller station is disclosed in German Patent No. DT-PS 16 32 193, the disclosure of which is expressly incorporated by reference herein in its entirety. Moreover, the rolling can be alternatively carried out by belts instead of a rolling block, as disclosed in, e.g., German Patent Application No. DE 198 57 576 A1, the disclosure of which is expressly incorporated by reference herein in its entirety.

Figure 2:
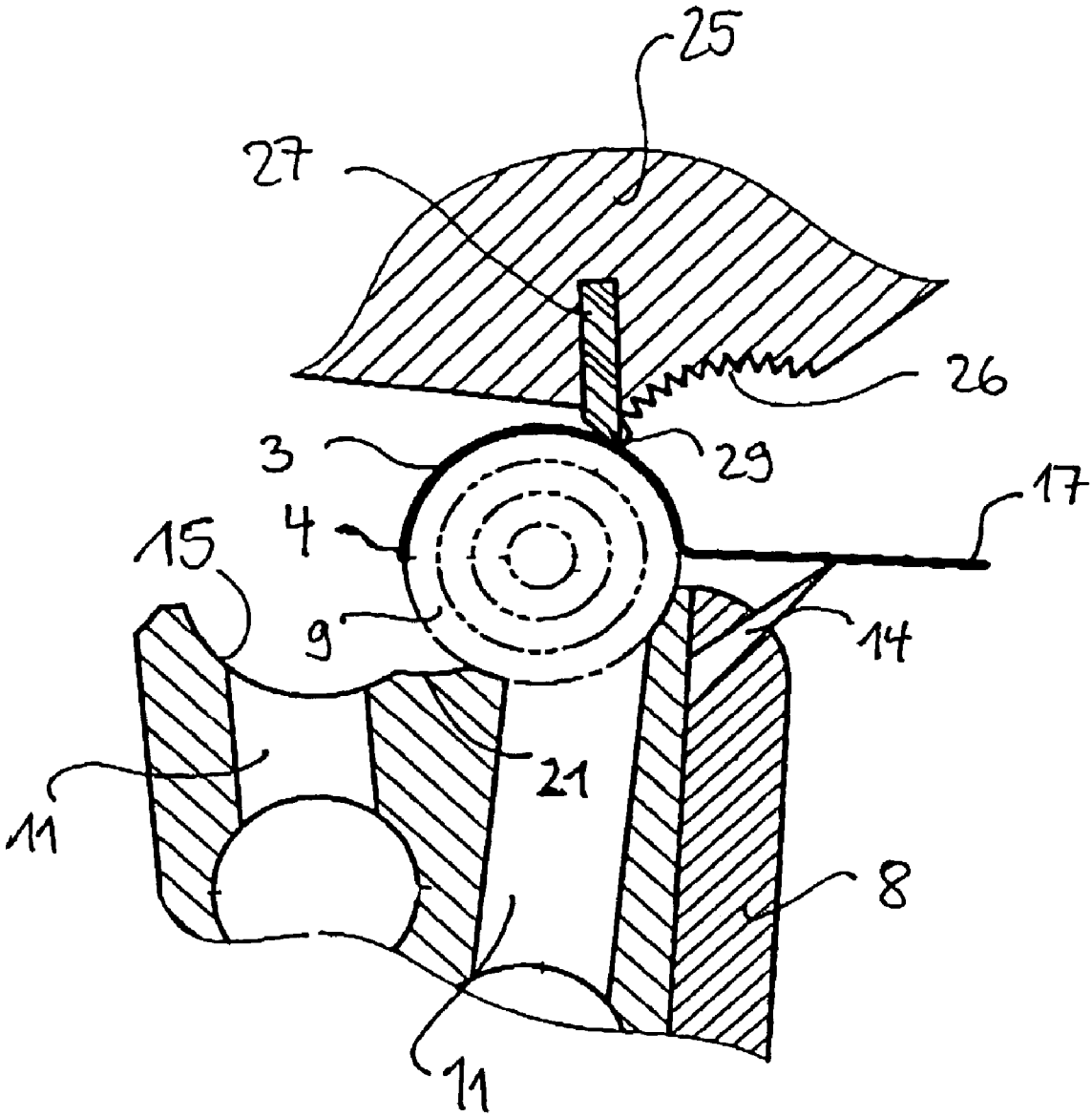
FIG. 2 illustrates a sectioned view of a starting phase of the displacement of partially connected components in the drum seat.

The start phase of the procedure for displacing (changing the seat position) the partially wrapped components in drum seat 8 via rotation of rolling star 25 is illustrated in FIG. 2. Rolling star 25 includes sliding elements having a start ridges 27 with projections 29, which are arranged to approach the partially wrapped cigarette/tip group 9 from behind during synchronous rotation of rolling star 25 and grooved drum 6, with respect to the conveyor direction of the drum 6, until projection 29 touches the partially wrapped group 9.

Since rolling star 25 rotates at a (somewhat) higher angular velocity than drum 6, projection 29 "overtakes" drum seat 8, such that an acceleration is applied to the partially wrapped components by projection 29. As a result, cigarette/tip group 9 is rotated toward a front groove 15 of drum seat 8, such that edge 4 of connecting sheet 3 comes to a stop in groove 15 and the free end of connecting sheet 3, which rests on (and is supported by) a (rearward) mandrel 14 of drum seat 8, remains constant in its length during this (rotational) movement of cigarette/tip group 9.

In order to securely transfer the partially wrapped components into groove 15, rolling star 25 includes a contact face 26 arranged to border projection 29 and that is shaped to curve inwardly. In this way, contact face 26 is structured to rest for a short time on the partially wrapped components during rotation of rolling star 25. Moreover, contact surface 26 can include a serrated or ribbed surface for contacting the partially wrapped components.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 Arrow
2 Suction roller
3 Connecting sheets
4 Edge
6 Grooved drum
7 Arrow
8 Drum seat
9 Cigarette/tip group
11 Vacuum intake air opening
12 Vacuum intake air opening
13 Recess
14 Holding mandrel
15 Groove
17 Free end
18 Roller drum
19 Arrow
24 Paper guide
25 Rolling star
26 Contact surfaces
27 Start ridge
28 Carrier brackets
29 Projection
30 Device

What is claimed:

1. A process for connecting smoking article components comprising:

feeding connecting sheets on a suction roller with a defined spacing;

feeding the smoking article components on a grooved drum;

transferring portions of the connecting sheets to the smoking article components, such that the connecting sheets partially connect the smoking article components; and reducing a spacing of the partially connected smoking article components.

2. The process in accordance with claim 1, wherein the connecting sheets comprise glued connecting sheets.

3. The process in accordance with claim 1, wherein the smoking article components comprise cigarette/tip groups.

4. The process in accordance with claim 3, wherein the cigarette/tip groups include at least one joint formed between a tobacco rod and a filter, and the transferring comprises partially wrapping the at least one joint with at least one of the connecting sheets.

5. The process in accordance with claim 4, further comprising:

rolling the partially wrapped cigarette/tip group to wrap an unwrapped portion of the at least one connecting sheet around the at least one joint.

6. The process in accordance with claim 3, wherein the cigarette/tip group is at least partially inserted into a seat of the suction roller.

7. The process in accordance with claim 6, wherein the connecting sheet is asymmetrically positioned relative to the seat of the suction roller.

8. The process in accordance with claim 1, further comprising:

rolling the partially connected smoking article components in order to wrap an unwrapped portion of the connecting sheets around the smoking components.

9. The process in accordance with claim 1, wherein the suction roll is arranged to hold the connecting sheet at least one of asymmetrically, relative to a recess in the suction roll, and partially.

10. The process in accordance with claim 1, wherein the connecting sheet is held asymmetrically prior to being transferred to the smoking article components and is held partially while being transferred to the smoking article components.

11. The process in accordance with claim 10, wherein, when the connecting sheet is partially held by the suction roller, a part of the connecting sheet not being held by the suction roller is at least partially adhered to the smoking article components.

12. The process in accordance with claim 1, further comprising holding each of the connecting sheets on the suction roller with a vacuum from at least two suction borings of the suction roller.

13. The process in accordance with claim 12, wherein the vacuum at the at least two suction borings is switched off in a predetermined order.

14. The process in accordance with claim 1, wherein, after the connecting sheets are transferred to the smoking article components, the process further comprises displacing the partially connected smoking article components.

15. The process in accordance with claim 14, wherein the displacement of the partially connected smoking article components occurs within a seat of the grooved drum.

16. The process in accordance with claim 14, wherein the displacement comprises accelerating the partially connected smoking article components.

17. The process in accordance with claim 14, wherein, at least one of during and after the displacement, the spacing of the seats of the grooved drum is reduced.

18. The process in accordance with claim 1, wherein, after the reducing of the spacing, the process further comprises transferring the partially connected smoking article components to a roller drum, wherein a spacing of the transferred partially connected smoking article components corresponds to the reduced spacing of the grooved drum after the displacement.

19. The process in accordance with claim 18, wherein, after the transfer to the roller drum, the connecting sheets and the smoking article components are joined with a same spacing.

20. The process in accordance with claim 1, wherein, before transferring the connecting sheets to the smoking article components, the connecting sheets and the smoking article components are fed with a same spacing.

21. The process in accordance with claim 1, wherein the connecting sheets and the smoking article components are joined with a same spacing.

22. The process in accordance with claim 18, wherein, after transfer of the partially connected components to the roller drum, the spacing of the seats of the grooved drum is increased.

23. The process in accordance with claim 18, further comprising rolling the smoking article components after the transfer to the roller drum to wrap the connecting sheet around the smoking article component.

24. The process in accordance with claim 1, further comprising multiple rolling of the partially connected smoking article components.

25. The process in accordance with claim 1, further comprising at least one of accelerating and displacing the partially wrapped connecting sheets and smoking article components in a seat of the grooved drum.

26. A process for connecting tobacco rods and filters arranged as cigarette/tip groups comprising:

feeding adhesive connecting sheets on a suction roller;

feeding the cigarette/tip groups on a grooved drum;

connecting portions of the connecting sheets to junction points between the tobacco rods and the filters without rotating the cigarette/tip groups, thereby partially connecting the connecting sheets and cigarette/tip groups; and reducing a spacing of the partially connected smoking article components, wherein the partially connected connecting sheets are not wrapped around the cigarette/tip groups on the grooved drum.

27. The process in accordance with claim 26, wherein the connecting of portions of the connecting sheets to the junction points comprises inserting portions of the cigarette/tip groups and ends of the connecting sheets into recesses in the suction roll.

28. The process in accordance with claim 27, wherein the ends of the connecting sheets comprise leading edges, relative to a connecting sheet feed direction, of the connecting sheets.

29. The process in accordance with claim 26, wherein, prior to the connecting, the connecting sheets are arranged asymmetrically over recesses of the suction roller, relative to a connecting sheet feed direction, and the process further comprises suctioning both ends of the connection sheets, relative to the connection sheet feed direction.

30. The process in accordance with claim 29, wherein the suctioning is discontinued on the leading sides of the recesses during the connections of the connecting sheets to the cigarette/tip groups, and at least portions of the cigarette/tip groups are inserted into the recesses of the suction roller along with leading edges of the connecting sheets released by the suction roller when the suctioning on the leading sides of the recesses was discontinued.

31. The process in accordance with claim 26, further comprising rotating the partially connected connecting sheets and cigarette/tip groups within seats of the groove drum.

32. The process in accordance with claim 31, wherein the partially connected connecting sheets and cigarette/tip groups are rotated by an acceleration force applied to the cigarette/tip groups by a star roller.

33. The process in accordance with claim 31, wherein, at least one of during and after rotating the partially connected connecting sheets and cigarette/tip groups, a spacing between successive partially connected connecting sheets and cigarette/tip groups is reduced.

34. The process in accordance with claim 33, wherein the spacing is reduced to correspond to a spacing on a roller drum arranged downstream from the star roller.

35. The process in accordance with claim 34, further comprising transferring the partially connected connecting sheets and cigarette/tip groups to the roller drum.

36. The process in accordance with claim 26, further comprising rolling the partially connected connecting sheets and cigarette/tip groups, whereby the connecting sheets completely wrap around the cigarette/tip groups.

37. A device for connecting smoking article components comprising:

a suction roller structured and arranged to feed connecting sheets with a defined spacing;

a grooved drum arranged to feed the smoking article components;

said suction roller and said grooved drum being arranged to transfer the connecting sheets to the smoking article components and to partially connect the connecting sheets and the smoking article; and a device for reducing a spacing of the partially connected smoking article components.

38. The device in accordance with claim 37, wherein the connecting sheets comprise glued connecting sheets.

39. The device in accordance with claim 37, wherein the smoking article components comprise tobacco rods and filters arranged into cigarette/tip groups, and said suction roller and said grooved drum are arranged to transfer the connecting sheets to junction points between the tobacco rods and filters of the cigarette/tip groups and to partially connect the connecting sheets and cigarette/tip groups.

40. The device in accordance with claim 37, wherein said suction roller comprises semicircular recesses.

41. The device in accordance with claim 40, wherein said recesses are positioned asymmetrically with regard to a feed position of the connecting sheets.

42. The device in accordance with claim 37, wherein said suction roller comprises at least two suction borings to hold a connecting sheet.

43. The device in accordance with claim 42, wherein said suction borings are switched off in a certain order.

44. The device in accordance with claim 42, wherein said suction borings are arranged on opposite sides of recesses formed in said suction roller.

45. The device in accordance with claim 44, wherein said recesses are asymmetrically positioned under the connecting sheets being fed by said suction roller.

46. The device in accordance with claim 37, further comprising at least one position change element arranged to displace the partially connected connecting sheets and the smoking article components.

47. The device in accordance with claim 46, further comprising a transfer drum arranged downstream from said suction roller, with respect to a machine direction, wherein said position change element is positioned between said suction roller and said transfer drum.

48. The device in accordance with claim 46, wherein said position change element comprises at least one sliding element arranged to contact the partially connected connecting sheets and the smoking article components.

49. The device in accordance with claim 48, wherein said at least one sliding element comprises a plurality of sliding elements arranged with a larger spacing than a largest spacing of seats of said grooved drum.

50. The device in accordance with claim 46, wherein said position change element comprises a rotational body.

51. The device in accordance with claim 37, wherein said device for reducing a spacing of the partially connected smoking article components comprises a plurality of seats of the grooved drum are structured and arranged such that spacing between the seats can be changed.

52. The device in accordance with claim 51, wherein said seats are structured to be wider than a circumference of the smoking article components.

53. The device in accordance with claim 51, wherein said seats comprise at least one of a supporting shoulder and a roughened surface.

54. The device in accordance with claim 51, further comprising a device for changing the spacing between said seats of said grooved drum.

55. The device in accordance with claim 37, further comprising at least one rolling station arranged to wrap the connecting sheets around the junction points of the smoking article components.

56. The device in accordance with claim 37, further comprising a position change element arranged to contact the smoking article components.

57. The device in accordance with claim 56, wherein said position change element is arranged to at least one of accelerate and displace the smoking article components partially connected to the connecting sheets in seats of said grooved drum.

58. A machine of the tobacco processing industry comprising the device in accordance with claim 37.

59. The machine in accordance with claim 58, wherein said machine is structured and arranged as a filter tipping machine.

* * * * *